US008167623B2

(12) United States Patent
Schlichtherle et al.

(10) Patent No.: US 8,167,623 B2
(45) Date of Patent: May 1, 2012

(54) MULTI CONTACT BRUSH FOR SLIP RINGS

(75) Inventors: Johann Schlichtherle, Kaufbeuren (DE); Raimund Masch, Emmering (DE)

(73) Assignee: Schleifring und Apparatebau GmbH, Furstenfeldbruck (DE)

( * ) Notice: Subject to any disclaimer, the term of this patent is extended or adjusted under 35 U.S.C. 154(b) by 0 days.

(21) Appl. No.: 12/908,282

(22) Filed: Oct. 20, 2010

(65) Prior Publication Data

US 2011/0081789 A1 Apr. 7, 2011

Related U.S. Application Data

(63) Continuation of application No. PCT/EP2009/054889, filed on Apr. 23, 2009.

(51) Int. Cl.
*H01R 39/00* (2006.01)

(52) U.S. Cl. ..... 439/26; 310/248; 310/232

(58) Field of Classification Search ..... 439/26, 439/29, 25, 30; 310/246, 248, 245, 251, 310/232

See application file for complete search history.

(56) References Cited

U.S. PATENT DOCUMENTS

| | | | | |
|---|---|---|---|---|
| 2,269,614 | A | 1/1942 | von Soden | |
| 3,329,923 | A * | 7/1967 | Davis | 439/28 |
| 3,398,387 | A * | 8/1968 | Wendell | 439/26 |
| 4,358,699 | A | 11/1982 | Wilsdorf | |
| 4,398,113 | A * | 8/1983 | Lewis et al. | 310/232 |
| 4,447,752 | A * | 5/1984 | Boyce et al. | 310/232 |
| 4,483,574 | A | 11/1984 | Chabrerie et al. | |
| 4,856,323 | A * | 8/1989 | Morishita et al. | 73/117.02 |
| 5,124,608 | A * | 6/1992 | Lawrence et al. | 310/232 |
| 7,481,655 | B2 * | 1/2009 | Horst et al. | 439/24 |

FOREIGN PATENT DOCUMENTS

| | | | |
|---|---|---|---|
| EP | 0662736 | A1 | 7/1995 |
| EP | 1458079 | A1 | 9/2004 |
| JP | 3190074 | A | 8/1991 |
| WO | W02009130277 | A1 | 10/2009 |

OTHER PUBLICATIONS

International Search Report, PCT/EP2009/054889, Sep. 11, 2009.

* cited by examiner

*Primary Examiner* — Tulsidas C Patel
*Assistant Examiner* — Harshad Patel
(74) *Attorney, Agent, or Firm* — Quarles & Brady LLP

(57) ABSTRACT

A sliding-contact arrangement or slipring includes a slide-track having a V-shaped groove and also a brush having at least two slide-wires which simultaneously make sliding contact with the V-shaped groove of the slide-track. Furthermore, the two slide-wires have different diameters and contact the slide-track at different angular positions. Thereby an increased tolerance to mechanical vibrations and shocks as well as a reduced contact resistance results.

19 Claims, 3 Drawing Sheets

MULTI CONTACT BRUSH FOR SLIP RINGS

PRIORITY CLAIM

This application is a continuation of pending International Application No. PCT/EP2009/054889 filed on Apr. 23, 2009, which designates the United States and claims priority from pending German Application 10 2008 001 361.7 filed Apr. 24, 2008.

BACKGROUND OF THE INVENTION

1. Field of the Invention

The invention relates to a device for transmitting electrical signals by means of sliding contacts between parts that are movable relative to each other. Transmission systems of this kind are used preferably in linear embodiments, or in cylindrical or plate-shaped embodiments for rotating systems, also called slip rings or rotary joints. A sliding contact, often referred to as brush, or a plurality of sliding contacts is disposed to slide on a slide-track of electrically conducting material, the sliding contacts also being of an electrically conducting material. An electric current can be transmitted by electrical contact between the slide-tracks and a contact.

2. Description of Relevant Art

Sliding contact arrangements are used for example in a linear embodiment in crane installations or other conveyor systems for effecting transmission between a movable crane and a stationary control unit. Another field of use of sliding contacts of circular design, also known as slip rings or rotary joints, is that of transmission between parts that are rotatable relative to each other. A typical field of application, for example, is in computer tomographs between a rotor which carries an X-ray tube and a detector, and a stationary evaluation unit which processes and displays image data. Often, particularly those rotary joints of small constructional sizes, are sliding contacts on a metallic basis, for example in the form of a wire or a thin sheet.

A sliding-contact brush having a plurality of single wires is disclosed in U.S. Pat. No. 2,269,614. With this, it is assumed that at any one instant of time at least one wire will be in engagement with a slide-track.

U.S. Pat. No. 4,483,574 discloses a sliding-contact brush having a multiplicity of slide-wires, which is particularly suitable for application in collectors. Here the wires are of relatively short length, so that they will rest preferably vertically on top of the surface of a collector.

In EP 0 662 736 A1 a multiple-wire brush having two to five wires is disclosed, these lying adjacently in the groove of a slide-track with the wires simultaneously contacting the groove of the slide-track.

SUMMARY OF THE INVENTION

The embodiments are based on the object of improving the known contact brushes or sliding-contact arrangements so that an increased reliability of transmission and, in particular, a high insensitivity to mechanical vibrations and shocks is attained. In an embodiment a rotary joint includes: a circular slide-track disposed to rotate about an axis and having a V-shaped groove, and a brush including at least two slide-wires that simultaneously make sliding contact with the V-shaped groove, wherein the at least two slide-wires have different diameters and make contact with the slide-track at respectively different positions that are angularly displaced from each other along the slide-track with respect to the slide-track axis. Thus, the slide-wires make contact with the slide-track at respectively different positions along its length.

In a further embodiment a sliding-contact arrangement, includes: a circular slide-track disposed to rotate about an axis and having a V-shaped groove, and a brush including at least two slide-wires that simultaneously make sliding contact with the V-shaped groove; wherein the at least two slide-wires have different diameters and make contact with the slide-track at a same angular position along the slide-track with respect to the slide-track axis, but at different radial distances, so that a slide-wire having a larger diameter extends along a path of larger radius, and a slide wire having a smaller diameter extends along a path of smaller radius.

In another embodiment a sliding-contact arrangement includes at least two circular slide-tracks disposed to rotate about an axis and having V-shaped grooves, and a brush including at least two slide-wires, with at least one slide-wire being at any time in sliding contact with a respective V-shaped groove of a slide-track; wherein the at least two slide-wires have different diameters, and the at least two slide-wires are electrically connected in parallel with the at least two slide-tracks.

In a further embodiment a multiple-wire brush has at least two slide-wires for a sliding-contact arrangement including a slide-track with a V-shaped groove, wherein the slide-wires have different diameters.

In a further embodiment at least one slide-track with a V-shaped grove 5, has at least one multiple-wire brush running thereon and furthermore has at least two slide-wires 3, 4 of different diameters. It is essential that both slide-wires are electrically connected in parallel and run in the same V-shaped groove of the slide-track. Thus, they simultaneously contact the slide-track. Therefore, simultaneously there are two currents paths for the current to be transmitted. With this measure, on the one hand the contact resistance is reduced, and on the other hand the tolerance to mechanical shocks or vibrations is substantially increased, because both slide-wires have different resonance frequencies of their natural resonance. The different resonance frequencies result from the different spring constants and different masses owing to the different diameters. Thus, at a particular excitation frequency the probability is high that only one of the two slide-wires will be excited to vibrate, which can lead to brief contact interruptions. However, at the same time the other slide-wire having a different resonance frequency can continue to maintain the contact. The two slide-wires contact the slide-track at different angular positions 8, 9. Thereby an additional tolerance to mechanical vibrations is created, because these occur preferably along only one axis. Thus, for example, in vehicles shocks will occur preferably vertically to the ground. If now a second slide-wire is disposed along another direction or along another axis, then it can still maintain the flow of current.

In a further embodiment two slide-wires 3, 4 are be disposed at the same angular position 8 with respect to the slide-track. But they run along different radii 10, 11 within the V-shaped groove. Thereby reduced abrasion also results, because the paths of the contacts extend at different positions. Of course, here too an increased tolerance to mechanical vibrations results owing to the different wire diameters. Owing to the arrangement at an angular position, a substantially simpler mechanical design results than with the first-described embodiment.

Another embodiment consists in that at least two slide-tracks having V-shaped grooves are electrically connected in parallel, and in that at least two slide-wires of different diameters run along these. Preferably one slide-wire runs along each slide-track.

A multiple-wire brush includes at least two slide-wires of different diameters.

Preferably the ratios of the diameters of the at least two slide-wires are in a range of 1:1.2 to 1:5. Of particular advantage is a ratio of the diameters in a range of 1:1.5 to 1:2.

In another advantageous embodiment the at least two slide-wires include different materials.

In another advantageous embodiment, at least two slide-wires 3, 4 of different diameters are held in a holding device, for example a sleeve at one end of the slide-wires. Just as well, they can be simply soldered or squeezed together. They are connected together electrically and mechanically by the holding device. However, the other ends of the slide-wires remain movable relative to each other.

In another embodiment, exactly one slide-wire 3 having a larger diameter, and one slide-wire 4 having a smaller diameter are provided.

In another embodiment, a slide-wire 3 having a larger diameter and three slide-wires 4 having a smaller diameter are provided. The slide-wire 3 having the larger diameter runs along a path of the slide-track having a smaller radius, whilst the slide-wires 4 having the smaller diameter run along a path of the slide-track having a larger radius.

The embodiments disclosed herein are applicable to all types of sliding contact arrangement, like linear sliding rail systems or sliprings also called rotary joints, which is the preferred application.

BRIEF DESCRIPTION OF THE DRAWINGS

In the following the invention will be described by way of example, without limitation of the general inventive concept, on examples of embodiment and with reference to the drawings.

Figure 1:
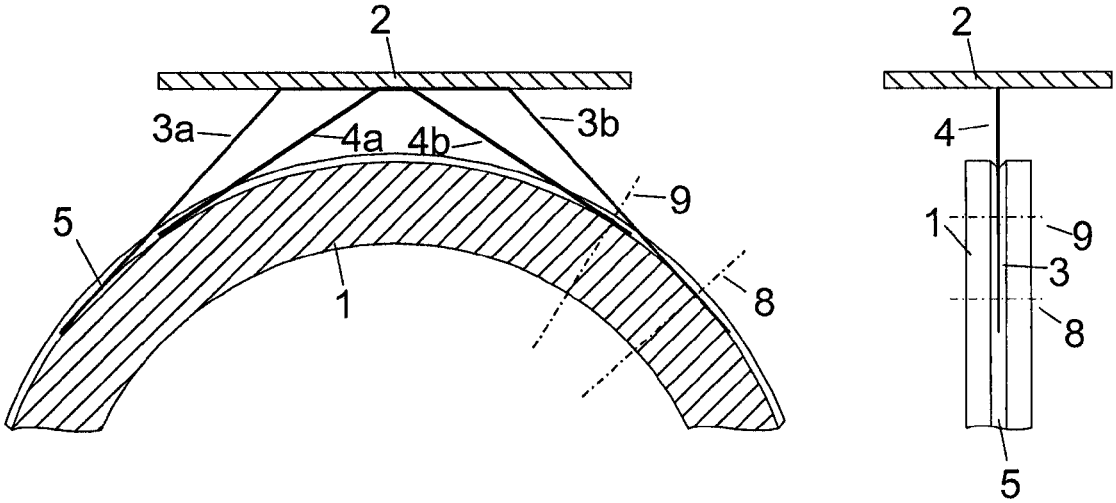
FIG. 1 schematically shows in a general form a sliding-contact arrangement.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

FIG. 1 shows a sliding-contact arrangement. Here the left-hand portion shows a cross-section through the slide-track 1 perpendicular to its rotation axis. A plan view of the slide-track as seen from a viewing angle perpendicular to the rotation axis is located in the right-hand portion of the Figure. The rotation axis extends perpendicularly to the plane of the drawing. Here a brush holder 2 holds two double-brushes 3, 4, with each double-brush including a slide-wire which here is held at the underside of the brush holder. Alternatively, the slide-wire also can be passed through the brush holder or form-locked with the brush holder in a different manner in order to increase the mechanical stability. Each slide-wire of the double-brushes shown here has two ends 3*a*, 3*b*, or 4*a*, 4*b*, with each end being in contact with the slide-track. Thus, for each slide-wire two points of contact with the slide-track result. Basically, however, it is possible also to make one-sided brushes having only one slide-wire 3*b*, 4*b* which is in contact with the slide-track at only one location. Two brushes of this kind are electrically connected in parallel and preferably mounted on a common brush block 2. Furthermore, the slide-wires of the brushes have different wire diameters.

Basically, the different diameters of the wires result in different mass ratios of the wires, and also different spring constants. Therefore the slide-wires also have different resonance frequencies. A slip ring known in prior art, having brushes of the same diameter, exhibits interruptions of contact at certain frequencies of mechanical vibrations. Typically these frequencies are the resonance frequencies or innate frequencies of the individual slide-wires. By this embodiment, contact is always ensured. If, for example, the first slide-wire is excited by mechanical vibrations at a first resonance frequency, then no excitation of the second slide-wire at a different resonance frequency occurs. Now in this case the entire current through the arrangement flows through the second slide-wire. The same applies correspondingly for the reverse case of an impaction with a vibration frequency corresponding to the resonance frequency of the second slide-wire. In this case the first slide-wire will carry the entire current.

It is of particular advantage for both the first slide-wire and also the second slide-wire to run in the same V-shaped groove 5 of a slide-track. For this, the two slide-wires must abut against the slide-track at different contact points 8, 9. For a flat brush holder, for example in the form of a plate and more preferably in the form of a printed-circuit board, this means furthermore that the slide-wires will emerge from it or be attached to it at different angles.

Figure 2:
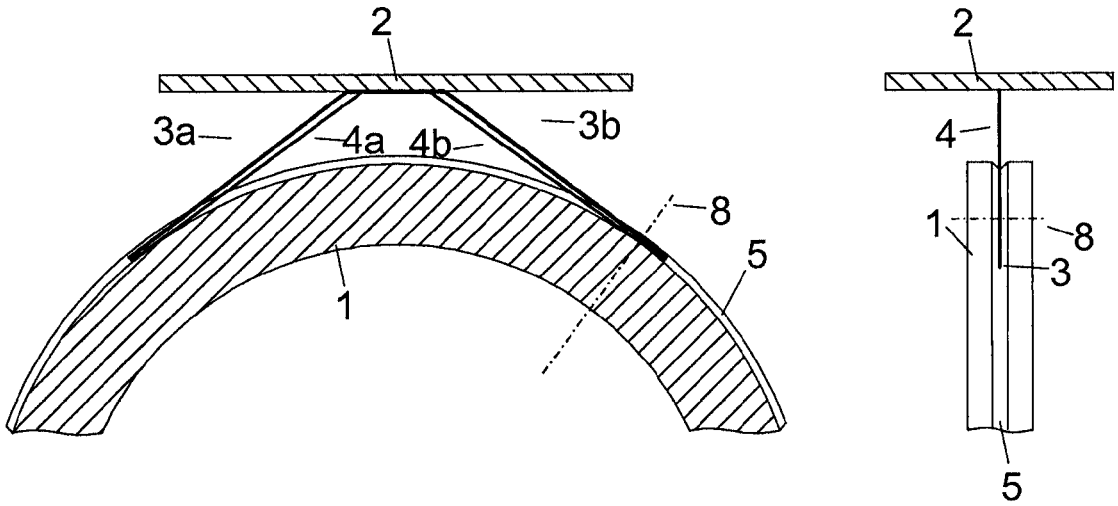
FIG. 2 shows another embodiment of a sliding-contact arrangement.

FIG. 2 shows an arrangement similar to the preceding one, however, with slide-wires abutting against the slide-track at the same angular position 8. Because of the different diameters of the slide-wires, the slide-wires will travel along slide-paths of different radii. Thus, the slide-wire 3 having a larger diameter will travel along a path located further towards the outside and having a larger radius 10, and the slide-wire 4 having a smaller diameter will travel along a path located further inwards and having a smaller radius 11. Whilst the preceding embodiment having contact points at different angular positions provides substantial freedom of dimensioning of the different diameters of the slide-wires, here attention must be given to choosing a relatively large diameter ratio, so that the two slide-wires 3, 4 can abut simultaneously within the V-shaped groove 5. It is preferred for a small gap which preferably is larger than the diameter of the thinner slide-wire to be present between the two slide-wires when they abut against the V-shaped groove. Here the diameter ratio is preferably within a range of 1:2 to 1:5.

Another advantage of this arrangement having two slide-wires of different diameters in the same V-shaped groove resides in less wear on the V-shaped groove. Owing to the different diameters, the slide-wires penetrate to different depths into the V-shaped groove and therefore travel therein along different paths. Altogether this provides a substantially better utilization with respect to the lifetime of the V-shaped groove. If slide-wires having the same diameters were to be used here, then they would travel along the same path and wear it out substantially more rapidly.

Figure 3:
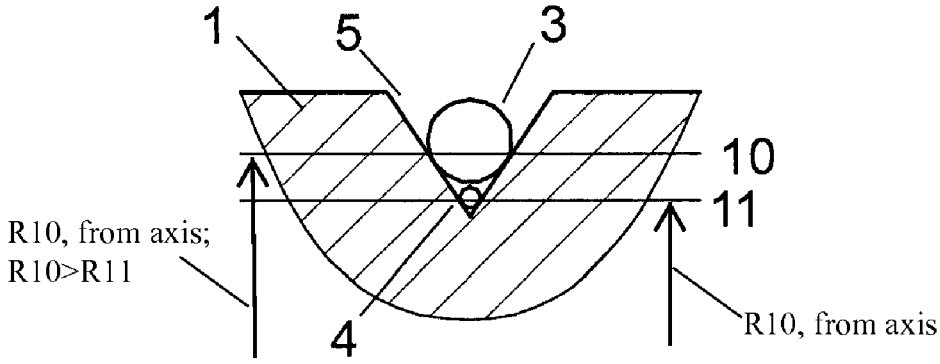
FIG. 3 shows a cross-section through the slide-wires and also the V-shaped groove of a sliding-contact arrangement

FIG. 3 shows the two slide-wires of FIG. 2 together with the V-shaped groove in a cross-section along the axis 8. Within the V-shaped groove 5 the second wire 4 having the smaller diameter lies closer to the tip of the V. The first wire 3 having the larger diameter lies at a distance above this. A line 11 has been drawn through the two points of support of the first wire 4 in the V-shaped groove 5, which are located on a slide-path having a smaller radius than is the case with the line 10 through the points of support of the first wire 3 having the larger diameter.

Figure 4:
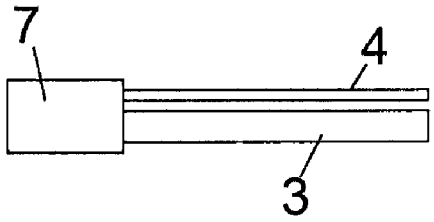
FIG. 4 shows an alternative brush configuration.

FIG. 4 shows an alternative brush configuration. Instead of the brush holder 2 having single wires 3, 4 shown in the preceding Figures, a multiple-wire brush also can be used. This can be disposed using a simple holder so that the two wires 3, 4 contact the slide-track. Here, for example, the two wires 3, 4 are gathered together electrically and mechanically into a unit by means of a sleeve. Connection of the wires is effected only within the sleeve, but not along the length of the wires, so that these wires are still free to move at the ends opposite to the sleeve.

Figure 5:
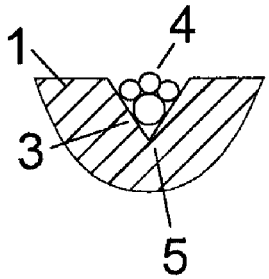
FIG. 5 shows a cross-section through another multiple-wire brush.

FIG. 5 also illustrates in section another brush together with the slide-track. Thus, here it has a first wire 3 of large diameter and a plurality of second wires 4 of smaller diameter. A brush of this kind can be built-up also on the basis of the previously illustrated brush holders 2.

Figure 6:
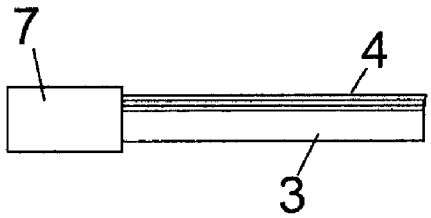
FIG. 6 shows a side view of another multiple-wire brush.

FIG. 6 shows a simple configuration of the multiple-wire brush of FIG. 5. Here the wires 3, 4 are gathered together within a sleeve or other fastening element and are connected to each other electrically and also mechanically. Connection of the wires is effected only within the sleeve, but not along the length of the wires, so that these wires are still movable at their ends opposite to the sleeve. Now a brush of this kind can be used in a slide-track similarly to the previously described double-brushes. Here the various wires now simultaneously abut against the V-shaped groove of the slide-track. Owing to the different resonance frequencies it is always ensured that with mechanical vibration loads at least one of the slide-wires is in contact with the slide-track. Here too, the additional advantageous effect of the lifetime of the arrangement being lengthened results, because the various wires travel along different paths.

Figure 7:
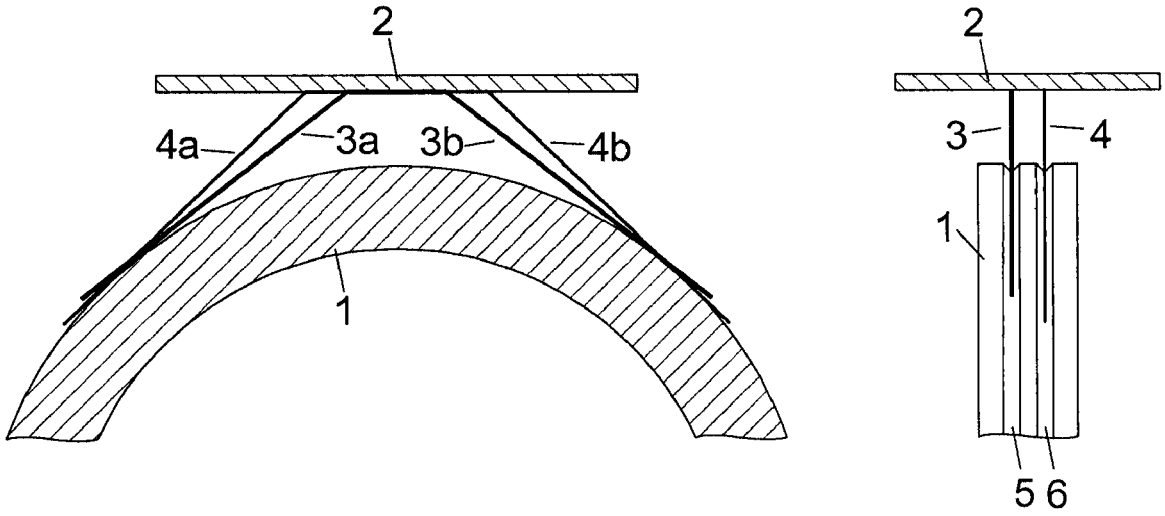
FIG. 7 shows an alternative configuration.

FIG. 7 shows another embodiment, in which the two different slide-wires 3, 4 travel along different V-shaped grooves 5, 6 of the slide-track. Of course, the two V-shaped grooves and also the two slide-wires are electrically connected in parallel.

It will be appreciated to those skilled in the art having the benefit of this disclosure that this invention is believed to provide optical rotary joints and micro-optical systems, such as collimators, used for multi-channel transmission of optical signals. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

1 slide-track
2 brush holder
3 first wire
4 second wire
5 first V-shaped groove
6 second V-shaped groove
7 sleeve
8 first point of support
9 second point of support
10 line through first points of support
11 line through second points of support

The invention claimed is:

1. A sliding contact arrangement comprising:

a circular slide-track having a V-shaped groove and rotatable about an axis; and a brush including a brush holder and at least two slide-wires articulated to the brush holder at corresponding attachment points, wherein the at least two slide-wires are configured to have different resonant frequencies such as to ensure uninterrupted sliding contact between the brush and the circular slide-track, and wherein the at least two slide-wires are further configured to contact the V-shaped groove at respective positions that are (i) angularly displaced from each other along the V-shaped groove and that are (ii) on the same side of a plane containing the axis and passing through a point of attachment between a slide-wire and the brush holder.

2. A sliding contact arrangement according to claim 1, wherein a ratio of diameters of the at least two slide-wires is between 1:1.2 and 1:5.

3. A sliding contact arrangement according to claim 1, wherein a ratio of diameters of the at least two slide-wires is 1:2.

4. A sliding contact arrangement according to claim 1, wherein the at least two slide-wires include different materials.

5. A sliding contact arrangement comprising:

a circular slide-track having a V-shaped groove and rotatable about an axis; and a brush including first and second slide-wires that are configured to have respective first and second diameters, the first and second diameters being different from one another, such as to ensure uninterrupted sliding contact between the brush and the circular slide-track, wherein the first and second slide-wires are further configured to be in sliding contact with the V-shaped groove at respective first and second radial positions defined with respect to the axis, the first and second radial positions being different from one another.

6. A sliding contact arrangement according to claim 5, wherein a ratio of the first and second diameters is between 1:1.2 and 1:5.

7. A sliding contact arrangement according to claim 5, wherein a ratio of the first and second diameters is 1:2.

8. A sliding contact arrangement according to claim 5, wherein the first and second slide-wires include different materials and are further configured to have different resonant frequencies.

9. A sliding contact arrangement comprising:

a slide-track having first and second V-shaped grooves; and a brush including first and second slide-wires respectively corresponding to the first and second V-shaped grooves, the brush being configured to ensure that at least one of said slide-wires is in sliding contact with the corresponding V-shaped groove, wherein said first and second slide-wires have different diameters, and wherein said first and second slide-wires are electrically connected in parallel with the first and second V-shaped grooves.

10. A sliding contact arrangement according to claim 9, wherein a ratio of the first and second diameters is between 1:1.2 and 1:5.

11. A sliding contact arrangement according to claim 9, wherein a ratio of the first and second diameters is 1:2.

12. A sliding contact arrangement according to claim 9, wherein the first and second slide-wires include different materials and are further configured to have different resonant frequencies.

13. A multi-wire brush for use with a sliding-contact arrangement that comprises a slide track having a V-shaped groove, the multi-wire brush including first and second slide-wires configured to have different diameters such as to define different resonant frequencies of said slide-wires and to ensure that, in cooperation with the sliding-contact arrangement, the brush remains in an uninterrupted sliding contact with the slide-track; wherein the at least two slide-wires are further configured to contact the V-shaped groove at respective positions and are angularly displaced from each other along the V-shaped groove and on the same side of a plane defined by an axis of rotation of the slide track and a point of attachment of a slide-wire to a multi-wire brush holder.

14. A multi-wire brush according to claim 13, wherein a ratio of said diameters is between 1:1.2 and 1:5.

15. A multi-wire brush according to claim 13, wherein a ratio of said diameters is 1:2.

16. A multi-wire brush according to claim 13, wherein the first and second slide-wires include different materials.

17. A multiple-wire brush according to claim 13, further including a holding device being configured to fasten first ends of the first and second slide-wires such as to establish mechanical and electrical cooperation between said first ends and to ensure that second ends of the first and second slide-wires are movable with respect to one another.

18. A multiple-wire brush according to claim 17, wherein the holding device is a sleeve.

19. A multiple-wire brush according to claim 13, wherein the brush includes the first slide-wire having a first diameter and further includes a plurality of slide-wires each of which has a corresponding diameter that is smaller than the first diameter, and wherein the first slide-wire is configured to run, along the V-shaped groove, on a path having a first radius, and each of the remaining slide-wires is configured to run, along the V-shaped groove, on a respectively corresponding path having a radius that is larger than the first radius.

* * * * *